US006221554B1

(12) United States Patent
Norris et al.

(10) Patent No.: US 6,221,554 B1
(45) Date of Patent: Apr. 24, 2001

(54) SELF DEVELOPING-FILM UNIT

(75) Inventors: Philip R. Norris, North Reading; Harry R. Parsons, Burlington; William T. Plummer, Concord; Donald W. Preissler, Sudbury; Robert J. Wadja, Wellesley, all of MA (US)

(73) Assignee: Polaroid Corporation, Cambridge, MA (US)

( * ) Notice: Subject to any disclaimer, the term of this patent is extended or adjusted under 35 U.S.C. 154(b) by 0 days.

(21) Appl. No.: 09/478,707

(22) Filed: Jan. 6, 2000

(51) Int. Cl.[7] ..... G03C 8/46; G03C 8/52; G03C 8/42; G03C 11/12

(52) U.S. Cl. ..... 430/207; 430/212; 430/209; 430/227; 430/256; 430/259

(58) Field of Search ..... 430/207, 212, 430/256, 259, 227, 209

(56) References Cited

U.S. PATENT DOCUMENTS

| | | | | |
|---|---|---|---|---|
| 4,033,770 | * | 7/1977 | DeHaes et al. | 430/256 |
| 4,285,999 | * | 8/1981 | Olivieri et al. | 428/40 |
| 4,464,454 | * | 8/1984 | Vogt | 430/256 |
| 4,808,509 | * | 2/1989 | Vetvloet et al. | 430/207 |
| 4,824,761 | * | 4/1989 | Sturgis et al. | 430/207 |
| 4,992,353 | * | 2/1991 | Rodakis et al. | 430/207 |
| 5,888,693 | * | 3/1999 | Meschter et al. | 430/207 |
| 6,045,965 | * | 4/2000 | Cournoyer et al. | 430/259 |

OTHER PUBLICATIONS

"Image Transfer Material" *Research Disclosure* No. 15513, Mar. 1977, pp. 8 & 9.*

* cited by examiner

*Primary Examiner*—Richard L. Schilling
(74) *Attorney, Agent, or Firm*—Tim A. Cheatham; Gaetano D. Maccarone

(57) ABSTRACT

There is described a self-developing film unit which has a photosensitive member and an image-receiving member and wherein one outermost surface of the film unit comprises a support layer carrying a layer of a releasable material and a layer of an adhesive material. After an image is formed in the film unit by photoexposure of the photosensitive element and photographic processing of the exposed photosensitive element, the support and releasable material layer can be removed and the film unit or the image-receiving element, as the case may be, adhered to a surface for viewing of the image.

16 Claims, 2 Drawing Sheets

SELF DEVELOPING-FILM UNIT

This invention relates to photography and, more particularly, to novel photographic film units for forming images by diffusion transfer.

BACKGROUND OF THE INVENTION

Diffusion transfer film units of the self-developing or instant type are well known in the art. Such film units which generally include a photosensitive element, an image receiving element and a photographic processing composition, can be provided in black and white or multicolor formats. Further, such diffusion transfer film units may be of the type wherein the image-receiving element is designed to be separated from the photosensitive element after photoexposure and photographic processing are carried out, commonly referred to as "peel-apart" film units or they may be of the type wherein the photosensitive and image-receiving elements are designed to be maintained together after image formation is completed, commonly referred to as "integral" film units.

Typically, the images formed with diffusion transfer film units are stored in photo albums or placed in picture frames for viewing. However, as the state of the art advances and new uses are proposed for such images it would be desirable to have diffusion transfer film units where the images formed could be adhered to any convenient surface for viewing.

SUMMARY OF THE INVENTION

These and other objects and advantages are obtained in accordance with the invention by providing a self-developing film unit which includes a photosensitive element, an image-receiving element and wherein one outermost surface of the film unit comprises a support layer carrying a layer of a releasable material and a layer of an adhesive material. After an image is formed in the film unit by photoexposure of the photosensitive element and photographic processing of the exposed photosensitive element, the releasable material layer can be removed and the image-receiving element or the film unit, as the case may be, adhered to a surface for viewing the image.

The diffusion transfer film units of the invention may be adapted to provide black and white images or multicolor images. Further, the film units may be of the integral type or the peel apart type. In a preferred embodiment there is provided according to the invention an integral, multi color diffusion transfer photographic film unit.

BRIEF DESCRIPTION OF THE DRAWINGS

For a better understanding of the invention as well as other objects and further features thereof, reference is made to the following detailed description of various preferred embodiments thereof taken in conjunction with the accompanying drawings wherein.

DESCRIPTION OF THE PREFERRED EMBODIMENTS

The diffusion transfer photographic film units of the invention include those wherein the image-receiving element is designed to be separated from the photosensitive element after exposure and photographic processing are carried out.

Various embodiments of peel-apart diffusion transfer film units are known and include those wherein images are formed in black and white (reduced silver) and color (image dyes) as described in E. H. Land, H. G. Rogers and V. K. Walworth in Neblettes Handbook of Photography and Reprography, 7th Edition, J. M. Sturge, editor, Van Nostrand Reinhold, New York 1977, pp 258–330; and V. K. Walworth and S. H. Mervis in Imaging Processes and Materials, Neblettes Eighth Edition, J. Sturge, V. Walworth and A. Shepp, editors, Van Nostrand Reinhold, New York, 1989, pp 181–225. Additional examples of peel-apart film units are described in U.S. Pat. Nos, 2,983,606, 3,345,163, 3,362,819, 3,594,164, 3,594,165, and 5,593,809. Black and white film units according to the invention can be provided in both the peel-apart and integral formats as described, for example, in U.S. Pat. Nos. 2,543,181, 4,489,152 and 5,858,608. All the foregoing references are incorporated by reference herein.

A particularly preferred embodiment according to the invention comprises an integral film unit such as is described in U.S. Pat. No. 3,415,644 which is incorporated by reference herein. In commercial embodiments of this type of film unit e.g., SX-70 film from Polaroid Corporation, the support for the photosensitive element is opaque, the support for the image-receiving element is transparent and a light-reflecting layer against which the image formed in the image-receiving element is viewed is formed by distributing a layer of processing composition containing a light-reflecting pigment such as, for example, titanium dioxide, between the super posed elements. By also incorporating suitable pH-sensitive optical filter agents, preferably pH-sensitive pathalein dyes, in the processing composition as described in U.S. Pat. No. 3,646,347 which is incorporated by reference herein, the film unit may be ejected from the camera immediately after the processing composition has been applied such that the development process is completed in ambient light while the photographer watches the transfer image energy.

Figure 1:
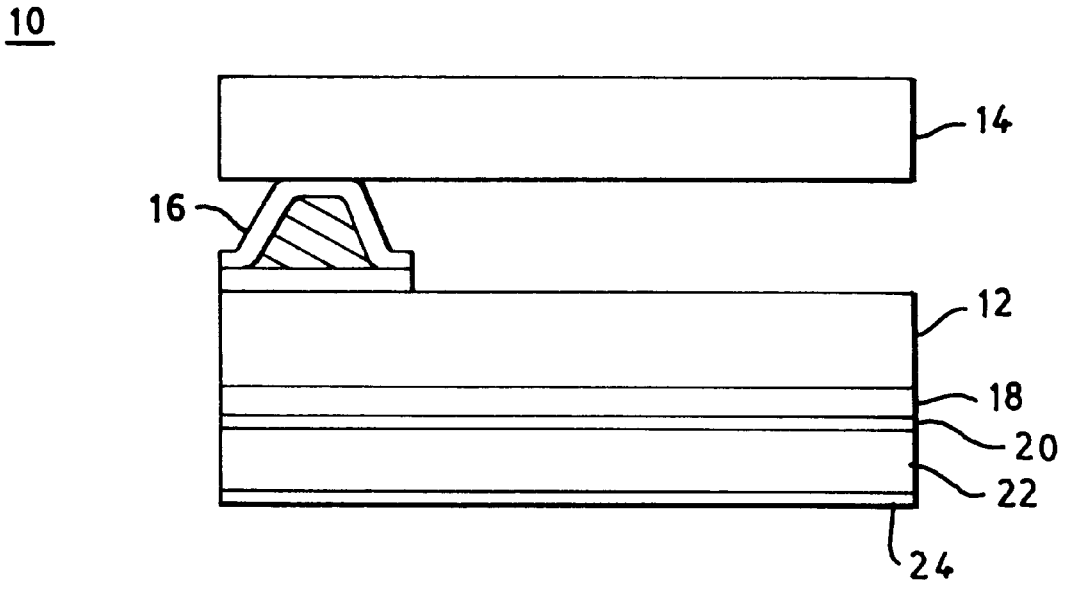
FIG. 1 is a partially schematic cross-sectional view of a preferred embodiment of a film unit according to the invention, wherein photoexposure of the photosensitive element and viewing of the image formed are through the same surface of the film unit.

Referring now to FIG. 1 there is seen a photographic film unit 10 according to the invention wherein the film unit is exposed, and the image formed in the film unit is viewed, through the support of the image-receiving element. The film unit 10 includes photo sensitive element 12, which includes an opaque support and image-receiving element 14, which includes a transparent support, arranged in superposed relationship with a rupturable pod 16 releasably holding a processing confirmation arranged between the photosensitive and image-receiving elements.

In a preferred embodiment the multicolor photosensitive element 12 is of the type described in U.S. Pat. No. 4,740,448, which is incorporated by reference herein, although any of the known types of multicolor diffusion transfer photosensitive elements may be utilized. Image-receiving element 14 may be any of those known for use in diffusion transfer photographic film units. In a preferred embodiment the image-receiving element comprises a transparent support carrying an image receiving layer.

Film unit 10 also includes a layer of an adhesive material 18, a layer of a release material 20, a support layer 22 and an optional layer of a release material 24.

In operation, film unit 10 is exposed through the image receiving element 14 and after photographic processing which is initiated by spreading the photographic processing composition between the photosensitive and image-receiving elements, such as by passing the film unit through a pair of rollers as is well known in the art, the image formed in the image-receiving element 14 is viewed through the support for that element. The support layer 22 can then be stripped away from the film unit, together with the release layer 20 thus leaving the adhesive layer as the outermost layer of the processed film unit and allowing the film unit to be affixed to any surface for viewing the image.

The adhesive layer 18 may comprise any suitable adhesive material and may be of any suitable thickness. Typically, adhesive layer is from about 0.4 mil (10 $\mu$m) to about 1 mil (25.4 $\mu$m) in thickness and preferably from about 0.6 mil (15 $\mu$m) to about 0.8 mil (20 $\mu$m). Preferred adhesives for layer 18 are photographically-compatible, water-based thermoplastic acrylic adhesives and in a particularly preferred embodiment layer 18 comprises a mixture of two water-based thermoplastic acrylic adhesives. Support layer 22 may comprise any suitable material and may be transparent or opaque. A typical suitable material is an approximately 0.92 mil (24 $\mu$m) thick polyester sheet material. Support layer 22 may be of any thickness; however it is preferred to have the layer be from about 20–25 $\mu$m for various reasons such as the considerations involved in passing the film unit through a pair of rollers to spread the processing composition.

As is well known in the art the processing composition is applied to the film unit typically by passing the film unit through a pair of opposed spread rollers which cause the rupturable container 16 to rupture in the desired predetermined edge whereby the processing composition is spread uniformly throughout the picture area of the film unit. The film unit typically includes a mask sheet which has a rectangular aperture formed therein which ultimately will frame the resulting picture formed in the image-receiving element because of the parallel side rails on each side of the film unit in the processing composition spreading direction and the opposed leading and trailing edge masking areas. For a detailed description of a mask layer structure see, for example, U.S. Pat. No. 4,824,761 which is hereby incorporated by reference herein. The processing composition flows into a chamber formed by the side rails and the layers or elements of the film unit between which it is desired to deposit the processing composition. The thickness of the side rails determines the spacing between the layers or elements of the film unit where the processing composition is spread such that a predetermined thickness of a coating of the processing composition is applied. Thus, to facilitate the maintaining of a substantially uniform thickness of a coating of the processing composition the adhesive layer preferably extends, in the processing composition spreading direction, beyond the picture area. In the direction perpendicular to the processing composition spreading direction the adhesive layer extends beyond at least a substantial portion of the width of the rails, e.g., overlaps preferably about one-half to three quarters of the rail width.

Release layer 20 may comprise any suitable release material which adheres more strongly to support layer 22 than to adhesive layer 18 so release layer 20 will be stripped away from the film unit along with support layer 22 when it is desired to make the adhesive layer available for adhering the developed film unit to a surface for viewing. A preferred release layer 20 comprises an approximately 1 $\mu$m thick cross-linked silicone acrylic polymeric material.

In a preferred embodiment the film unit includes optional release layer 24. In a preferred method for manufacturing the film unit a discrete element comprising layers 18, 20, 22 and 24 is brought into contact with the support of the photosensitive element. This discrete element is typically provided in the form of a roll and therefore, in this instance, release layer 24 is present to prevent the adhesive layer 18 from adhering to another layer when the element is formed into a roll. Where release layer 24 is present in addition to release layer 20, there should be a differential in the release characteristics of the two release layers, that is release layer 24 should release at about one-half the force required to cause release layer 20 to separate from adhesive layer 18. Typically, release layer 24 should be separable at a force of from about 15 to about 25 grams/inch and release layer 20 at a force of about 60 to about 120 grams/inch. Release layer 24 preferably is an approximately 1 $\mu$m thick layer of a cross-linked silicone acrylic copolymer. Release layer 24 may also be formulated with silica particles, silicone beads or any like particles or beads to maintain a desired coefficient of friction on the surface of the film elements described in FIGS. 1 and 2.

Adhesive layer 18 should bind more strongly to photosensitive element 12 than either release layer binds to its adjacent layers, that is, the force required to separate adhesive layer 18 from photosensitive element 12 should be greater than the force (s) required to separate the release layer(s) from the next adjacent layer. The force required to separate adhesive layer 18 from photosensitive element 12 can vary. For example, where it is desired to provide a picture which can be adhered to a surface and subsequently removed and/or repositioned the force preferably is in the range of from about 400 to about 1000 grams/inch and where it is desired to affix the picture permanently the force preferably is in the range of from about 1000 to about 2000 grams/inch.

Figure 2:
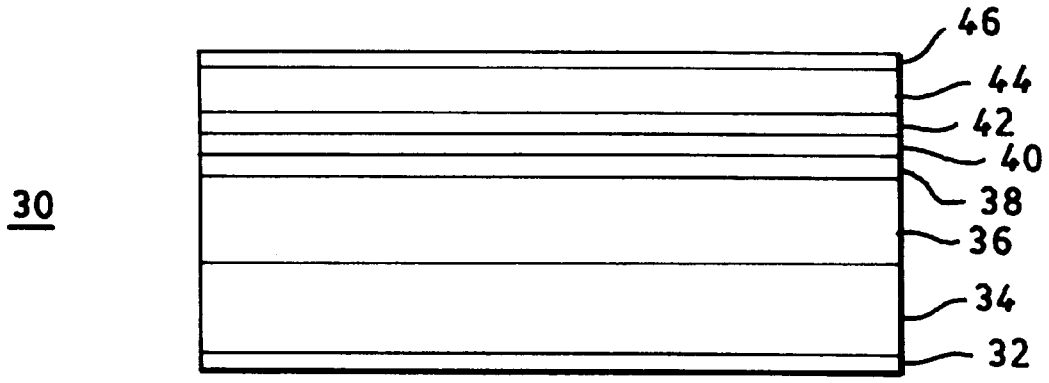
FIG. 2 is a partially schematic, cross-sectional view of a preferred embodiment of a film unit according to the invention wherein photoexposure of the photosensitive element and viewing of the image formed are through opposing surfaces of the film unit.

FIG. 2 illustrates a preferred embodiment of a film unit according to the invention, which is exposed and viewed through opposing outer surfaces. Diffusion transfer photographic film units of the type where exposure is made through one transparent outer surface and the image formed is viewed through the opposing outer surface are well known in the art and are described in detail for example in U.S. Pat. Nos. 3,594,165 and 3,689,262 which are incorporated by reference herein. In this type of film unit there are coated on one transparent support both the image-receiving and photosensitive elements and a transparent sheet element is arranged on the photosensitive element so as to form the other of the outer surface of the film unit.

Referring now to FIG. 2 there is seen a diffusion transfer film unit 30 according to the invention wherein transparent support layer 32 carries image-receiving element 34 and photosensitive element 36 and a transparent sheet element 38 is present. In this preferred embodiment, since the film unit is exposed through transparent sheet element 38 and the image is viewed through transparent support 32, adhesive layer 40 is arranged adjacent to transparent sheet element 38 and thus must be optically transparent. Release layer 42, support layer 44 and optional release layer 46 also must be optically transparent. Preferably, layers 40, 42, 44 and optional layer 46, where present, have a combined optical density less than about 0.3.

Figure 3:
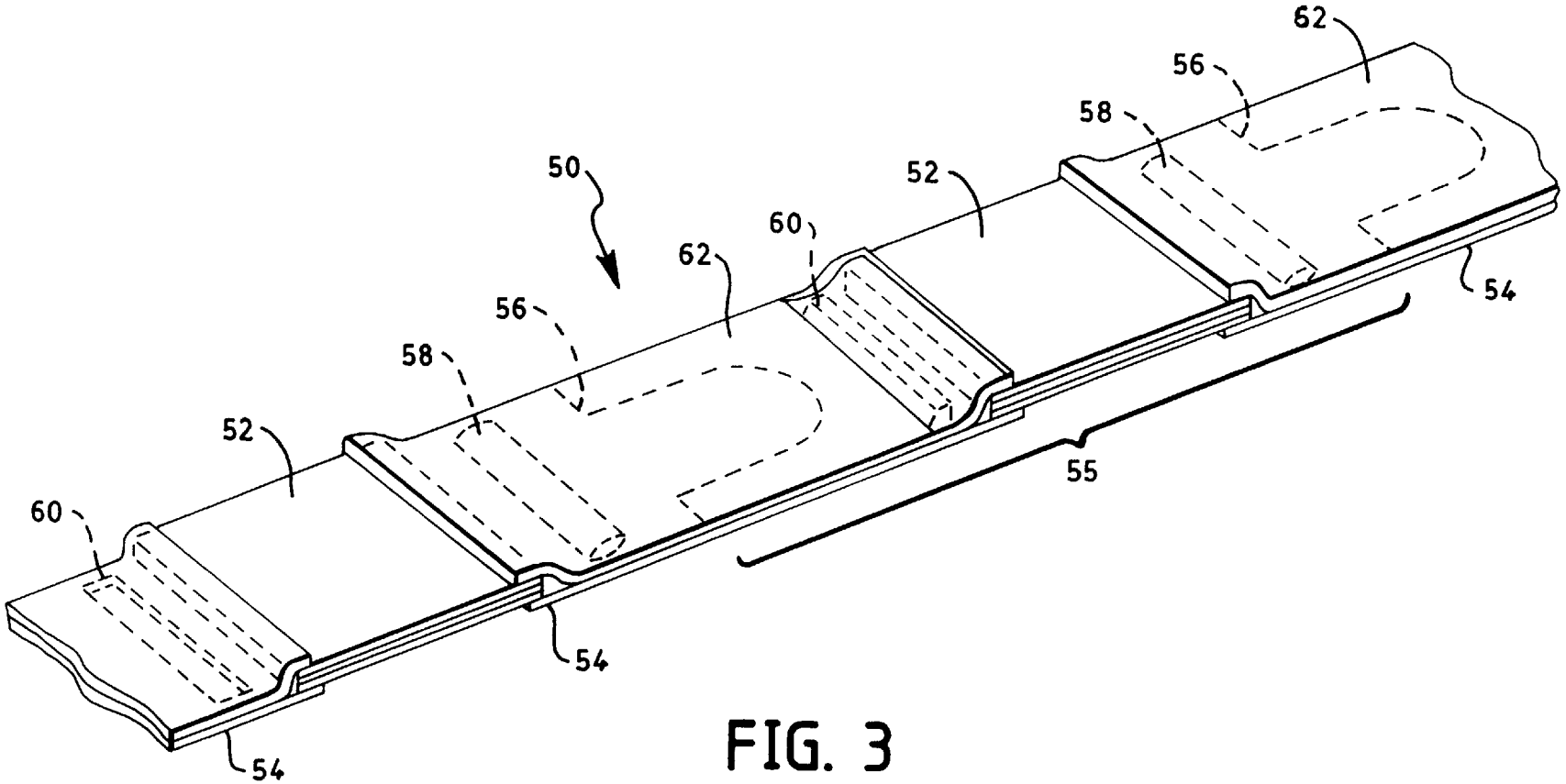
FIG. 3 is a partially schematic perspective view of a preferred embodiment of a film assemblage according to the invention.

A particularly preferred film assemblage according to the invention comprises the type described and claimed in U.S. Pat. No. 5,888,693 which is incorporated by reference herein. Referring now to FIG. 3 there is seen a perspective view of a film assemblage 50 according to the invention comprising self-developing film units 52 secured end to end to connection strips 54 in alternating arrangement to form a longitudinal strip. The film assemblage 50 is conveniently subdivided into image units, or frames, 55 extending lengthwise from a weakened section 56 on one connection strip 54 to the equivalent location 56 on the adjacent connection strip 54. The weakened sections 56 preferably represent structurally weakened sections intended to permit easy separation of successive image units 55.

Each image unit 55 comprises the film unit 52, a rupturable container, or pod, 58 containing photographic processing composition, and adjacent the leading edge of the film unit 52, a trap 60 adjacent the trailing edge of the film unit 52 adapted to receive excess processing conformation not consumed during processing of the film unit 52 in a cooperating exposure device such as a camera (not shown). Both the rupturable container 58 and the trap 60 are attached to the connection strip 54 by, for example, adhesives.

A liquid-tight fluid passageway is provided between the rupturable container 58 and the leading edge of the film unit 52 and between the trailing edge of the film unit 52 and the trap 60. In one embodiment a comer strip 62, generally coextensive in width with connection strip 54 is disposed on top of connection strip 54 and secured at its respective ends to the leading and trailing edges, respectively, of the film unit 52 by, for example, an adhesive. Furthermore, the connection strip 54 is secured and sealed fluid-tight along the side marginal portions proximate to the rupturable container 58 and along the side marginal portions proximate to the trap 60. In the region between rupturable container 58 and the trap 60 the connection strip 54 and the cover strip 62 are affixed such as by adhesives or by heat-sealing to each other so as to seal, in a liquid-tight manner, the rupturable container 58 and the trap 60 from the environment. The film assemblage 50 and the manner in which it cooperates with an exposure device such as a camera to form an image in each film unit are described in detail in U.S. Pat. No. 5,888,693 and therefore such description is not required here.

Film units 52 may be any of those previously described herein. In a preferred embodiment film units 52 comprise the type illustrated in FIG. 1 wherein exposure is effected, and the image formed in the image-receiving element is viewed, through the transparent support of the image-receiving element 14. In the preferred embodiment the film unit 52 is preferably disposed with the image receiving element remote from the connection strip 54 although it is apparent that, if so desired, the film unit could be disposed with the image-receiving element adjacent the connection strip.

In another preferred embodiment film units 52 comprise the type illustrated in FIG. 2 wherein exposure is effected through transparent sheet element 38 and the image is viewed through transparent support 32. In this embodiment it is preferred to arrange the image unit with the image-receiving layer 38 and the adhesive layer 40, the release layer(s) and the support layer 44 remote from the connection strip 54.

Although the invention has been described in detail with respect to various preferred embodiments thereof, those skilled in the art will recognize that the invention is not limited thereto but rather that variations and modifications can be made which are within the spirit of the invention and the scope of the amended claims.

What is claimed is:

1. A self-developing diffusion transfer photographic film unit comprising a first support carrying at least one silver halide emulsion layer, a second sheet-like element which is in superposed relationship, or adapted to be placed in superposed relationship with said photosensitive element, an image-receiving element positioned in one of said photosensitive or second sheet-like elements, means providing an aqueous alkaline processing composition for distribution between predetermined layers of said elements;

and arranged adjacent the surface of said first support remote from said silver halide emulsion layer or adjacent the surface of said second sheet-like element remote from said silver halide emulsion layer, in succession, a layer of an adhesive material, a first layer of a release material, a second support, and a second layer of a release material adjacent the surface of said second support remote from said first release material layer.

2. The self-developing film unit as defined in claim 1 including a red-sensitive silver halide emulsion layer in association with a cyan image dye-providing material, a green-sensitive silver halide emulsion layer in association with a magenta image dye-providing material and a blue-sensitive silver halide emulsion layer in association with a yellow image dye-providing material.

3. A film unit as defined in claim 2 further including means providing a light-reflecting layer against which an image formed in said image-receiving layer may be viewed and wherein said second sheet-like element comprises a support carrying said image-receiving layer.

4. A film unit as defined in claim 3 wherein said second sheet-like element further includes a timing layer and a polymeric acid-reacting layer.

5. A film unit as defined in claim 4 wherein said first support is opaque and said support of said second sheet-like element is transparent.

6. A film unit as defined in claim 5 wherein said adhesive layer is affixed to the surface of said first support remote from said silver halide emulsion layer.

7. A film unit as defined in claim 1 wherein said first layer of release material is separable from said adhesive material layer at a force in the range of from about 60 to about 120 grams/inch, said second layer of release material is separable from said second support at a force in the range of from about 15 to about 25 grams/inch and said second layer of release material is separable at about one-half of the force at which said first release layer is separable.

8. A film-unit as defined in claim 2 further including means providing a light-reflecting layer against which an image formed in said image-receiving layer can be viewed and wherein said first support is transparent, said first support carries said image-receiving layer and said second sheet-like element comprises a transparent layer.

9. A film unit as defined in claim 8 wherein said first support further carries a timing layer and a polymeric acid-reacting layer.

10. A film unit as defined in claim 9 wherein said adhesive layer is affixed to the surface of said second sheet-like element remote from said silver halide emulsion layers.

11. A film unit as defined in claim 10 wherein said first layer of release material is separable from said adhesive material layer at a force in the range of from about 60 to about 120 grams/inch, said second layer of release material is separable from said second support at a force in the range of from about 15 to about 25 grams/inch and said second layer of release material is separable at about one-half of the force at which said first release layer is separable.

12. A self-developing film assemblage comprising processing fluid supply means including a rupturable container of processing fluid at a leading end portion of the assemblage, a self-developing film unit as defined in claim 1, spacer means connected to and between said first support and said second sheet-like element for providing a processing space therebetween for allowing processing fluid to pass therethrough, fluid trap means at a trailing end portion of the film assemblage for collecting excess processing fluid traveling through said processing space, first light-tight coupling means including a third passage for fluidically coupling said container to a leading end of said processing fluid from a ruptured container to be introduced into said processing space and initiate processing of a latent image in said film unit, and second fluid-tight coupling means including a fluid passage for fluidically coupling a trailing end of said processing space with said trap means for allowing processing fluid to enter into said trap means, said first coupling means having one end portion sealably secured to an exterior surface of said container and a second end portion sealably secured to an exterior surface of a leading end portion of said film unit, and said second coupling means having an end portion sealably secured to and about the trailing end portion of said film unit and an opposite end portion sealably secured to an exterior surface of said trap means.

13. A self-developing film assemblage as defined in claim 12 wherein said film unit is as defined in claim 2.

14. A self-developing film assemblage as defined in claim 12 wherein said film unit is as defined in claim 8.

15. A self-developing film assemblage as defined in claim 12 wherein said film unit is as defined in claim 10.

16. A self-developing film assemblage as defined in claim 12 wherein said film unit is as defined in claim 10.

* * * * *